US006467511B2

(12) United States Patent
Sollars

(10) Patent No.: US 6,467,511 B2
(45) Date of Patent: Oct. 22, 2002

(54) SELVAGE YARN TENSIONING APPARATUS AND METHOD

(75) Inventor: John A. Sollars, LaGrange, GA (US)

(73) Assignee: Miliken & Company, Spartanburg, SC (US)

( * ) Notice: Subject to any disclaimer, the term of this patent is extended or adjusted under 35 U.S.C. 154(b) by 0 days.

(21) Appl. No.: 09/899,307

(22) Filed: Jul. 5, 2001

(65) Prior Publication Data

US 2002/0036023 A1 Mar. 28, 2002

Related U.S. Application Data

(60) Provisional application No. 60/216,193, filed on Jul. 6, 2000.

(51) Int. Cl.[7] ..... D03D 49/08

(52) U.S. Cl. ..... 139/430; 242/422.6; 242/129.8; 242/156.1; 66/146; 139/54

(58) Field of Search ..... 139/54; 66/146; 242/422.6, 129.8, 156.1

(56) References Cited

U.S. PATENT DOCUMENTS

| | | | | |
|---|---|---|---|---|
| 1,410,136 A | * | 3/1922 | Stevens | 242/421.2 |
| 2,920,840 A | | 1/1960 | Cooper | 242/156.2 |
| 3,912,191 A | * | 10/1975 | Anderson et al. | 242/75.43 |
| 4,240,471 A | * | 12/1980 | Rotrekl et al. | 139/114 |
| 5,133,513 A | * | 7/1992 | Cassidy | 242/156 |
| 6,199,598 B1 | | 3/2001 | Josefsson | 139/452 |
| 6,227,253 B1 | * | 5/2001 | Meyns | 139/54 |
| 6,240,974 B1 | * | 6/2001 | Hehle | 139/430 |
| 6,244,304 B1 | | 6/2001 | Hockemeyer et al. | 139/54 |

FOREIGN PATENT DOCUMENTS

| | | |
|---|---|---|
| DE | 1 931 659 | 8/1970 |
| DE | 1918 161 | 10/1970 |
| DE | 2 105 949 | 8/1972 |
| FR | 610 604 | 4/1979 |
| GB | 1 315 476 | 5/1973 |
| WO | 94/26646 | 11/1994 |

* cited by examiner

*Primary Examiner*—A. Vanatta
*Assistant Examiner*—Robert Muromoto
(74) *Attorney, Agent, or Firm*—Terry T. Moyer; Daniel R. Alexander

(57) ABSTRACT

A mechanism to automatically control tension of supplemental yarns added to a weaving or knitting machine has a pivotal control arm, one end of which is influenced by the tension of the yarn being controlled, while a counteracting force is applied to another end of the arm. The movement of the arm is used to modulate and adjust a braking device acting against the yarn holding spool to keep the tension of the yarn substantially uniform over time as the diameter of the yarn wound on the storage spool changes.

12 Claims, 14 Drawing Sheets

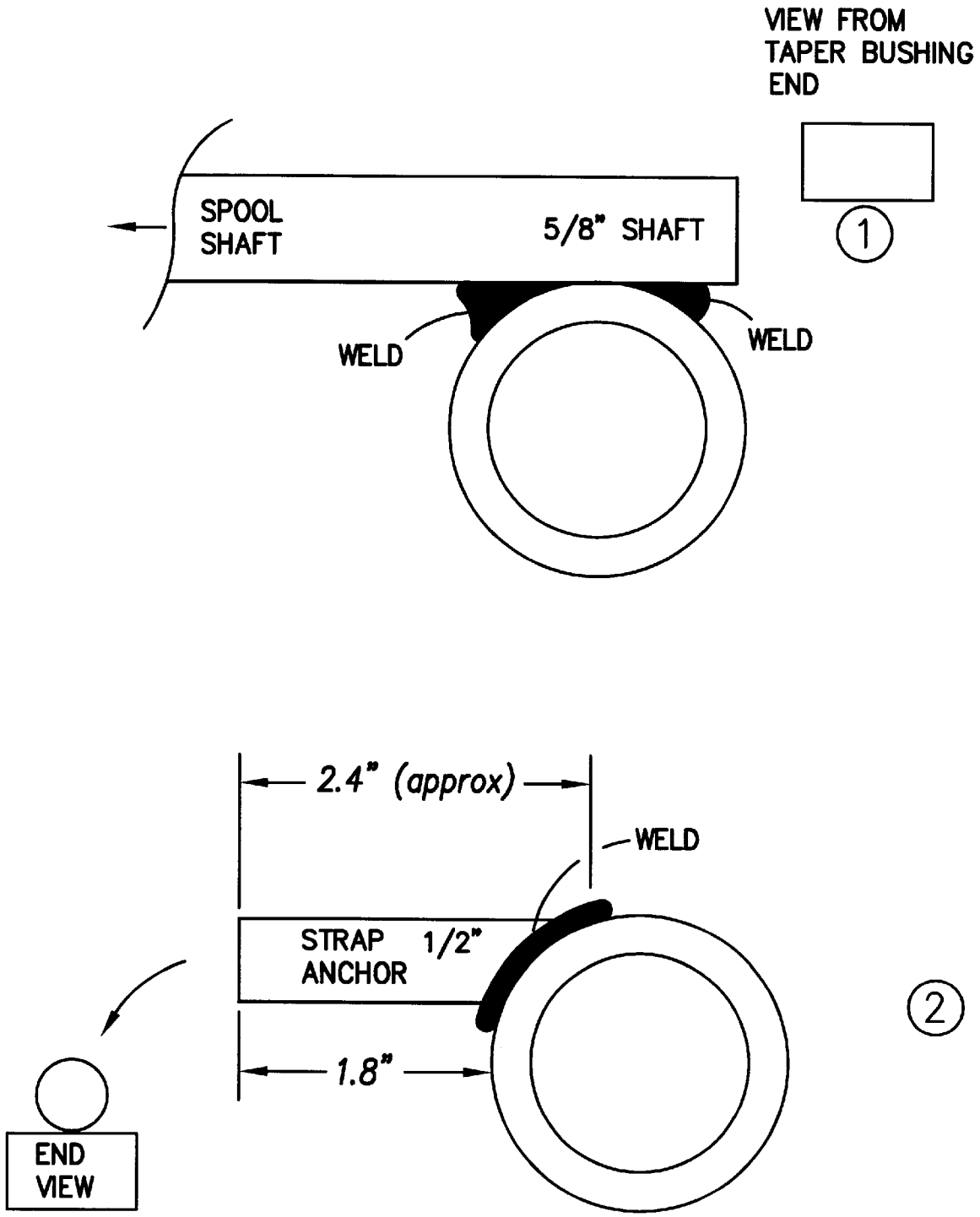
FIG. –10–

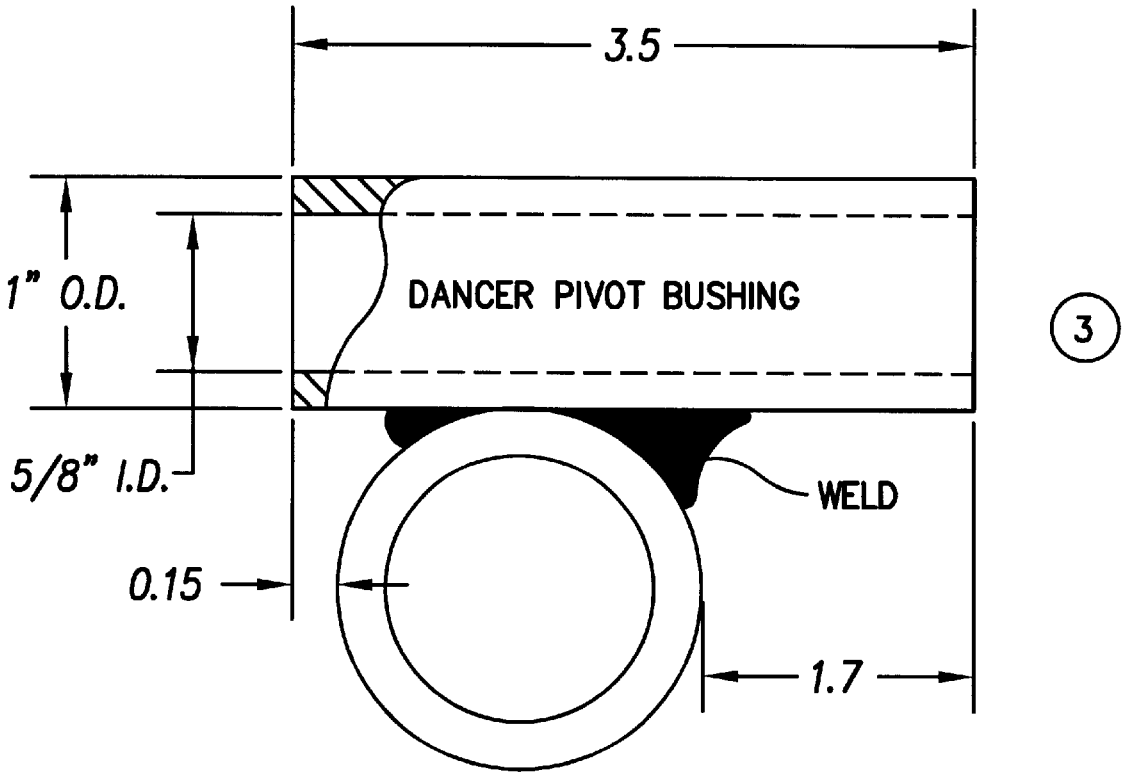
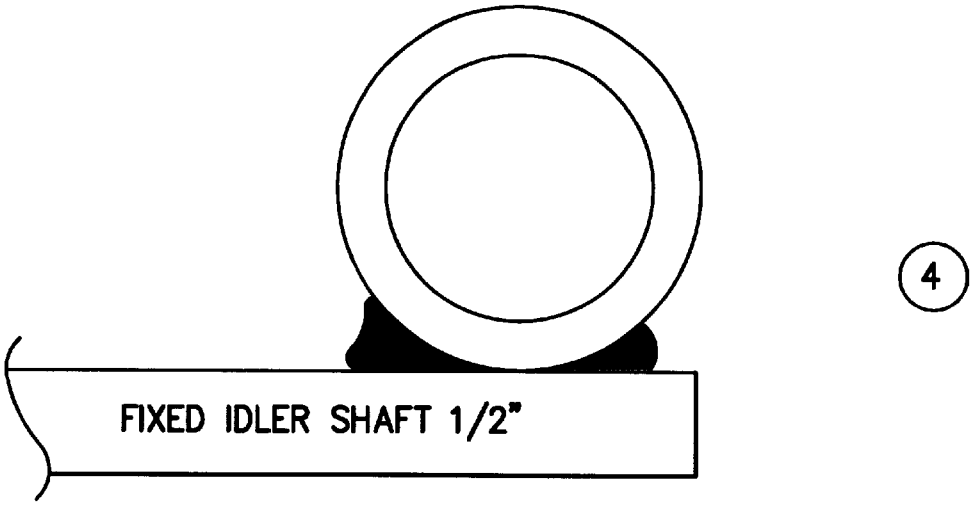
FIG. —11—

CONCEPT #1 USE EXISTING STRAPS ON SPOOL
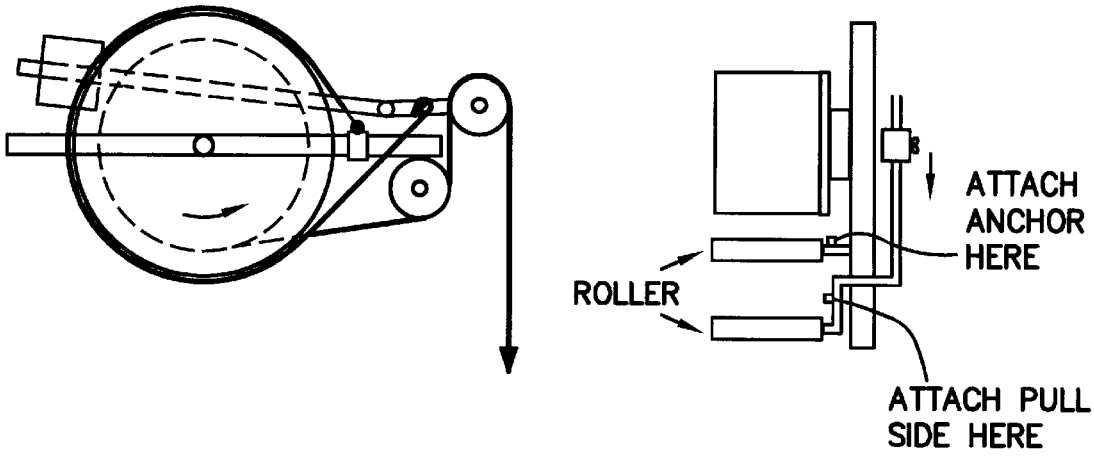
CONCEPT #2
USE STRAP TYPE BRAKE ON SHAFT COUPLED TO SPOOL
CONCEPT #3
SAME AS #2
BUT USE "OFF SHELF"
BRAKE ASSEMBLY. MECHANICAL
LINK FROM LEVER WORKS BRAKE
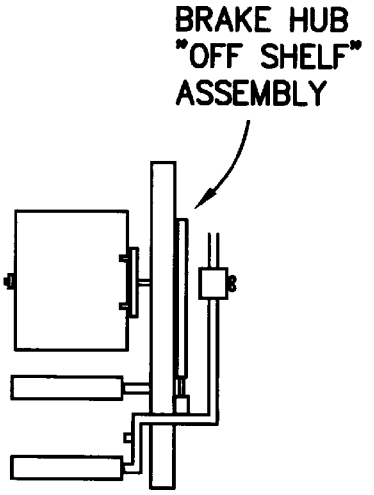
*FIG. —14—*

SELVAGE YARN TENSIONING APPARATUS AND METHOD

CROSS REFERENCE TO RELATED APPLICATIONS

This application claims priority to and the benefit of U.S. Provisional Patent Application Ser. No. 60/216,193, filed Jul. 6, 2000, and hereby incorporated by reference.

BACKGROUND OF THE INVENTION

This invention deals with an innovative apparatus and method to control the tension of one or more additional yarns utilized in the weaving of fabric and more particularly in the selvage of a woven fabric.

It is common in the weaving art to add additional yarns into the selvage area of fabric for a variety of reasons. It is common when there are more than a few yarns involved, that they be wound together onto a spool type device. This spool is then mounted on the weaving machine, thus allowing the yarns to be fed into the weaving process. To provide yarn tension to facilitate the weaving process, resistance to the rotation of the spool is provided typically by a strap loaded by a spring and wrapped around or near the perimeter of the spool. For example, a conventional selvage yarn tensioning device may include one or two circumferential straps which are spring biased against a constant diameter portion of the spool (spool edge) and there may be a traveling roller which contacts the yarn on the spool and which provides for a reduction in the spring tension as the effective diameter of the yarn remaining on the spool decreases. Such a roller is supported, for example, by one end of a lever arm which pivots about a shaft which also serves as an anchor for one end of each of the tensioning straps.

Since the amount of torque acting on the spool caused by the drag of the strap or straps would at best be relatively constant, the tension on the yarns would vary as the diameter of the yarns on the spool winds down. Mechanical devices have been added, such as, a wheel assembly which rides on the yarn in the spool and is connected through a lever in order to change the spring loading in an attempt to compensate for the change in diameter.

Such a conventional tensioning apparatus is shown in FIGS. 1 and 2. These schemes do not fully compensate for the diameter change effect, wear on the strap or spring, or differences in the coefficient of friction between multiple straps or spools. Also, it is difficult for machine operators to properly adjust the tension as the spring and straps wear, as the yarn is fed off of the spool, for different types of yarn, and the like.

Since the selvage yarn tension can not be properly maintained using conventional means, it is typical for machine operators to constantly monitor and adjust the selvage yarn tensioning devices in an attempt to maintain a constant tension on the selvage yarn. Hence, there exists a need for an improved selvage yarn tensioning apparatus and method.

SUMMARY OF THE INVENTION

In accordance with the present invention there is provided a simple and economical mechanical device that automatically adjusts the tension applied to the strap or other means used to brake the yarn spool such that the tension of the selvage yarn remains constant as the diameter of the yarn wound on the spool changes.

Also, provision is made for more consistent fabric properties due to increased consistency of the yarn woven into the selvage that influences filling crimp during weaving. Still further, there is provided a reduction in the amount of time spent by weaving personnel needed to adjust the selvage tensioning mechanism within the tolerance of yarn tension required to achieve desired fabric properties.

BRIEF DESCRIPTION OF THE DRAWINGS

FIGS. 7 through 12 are respective schematic part drawings of the components of the selvage yarn tensioning device of FIG. 6.

FIGS. 13 and 14 are schematic representations of different embodiments of the present invention.

DETAILED DESCRIPTION OF THE INVENTION

Figure 1:
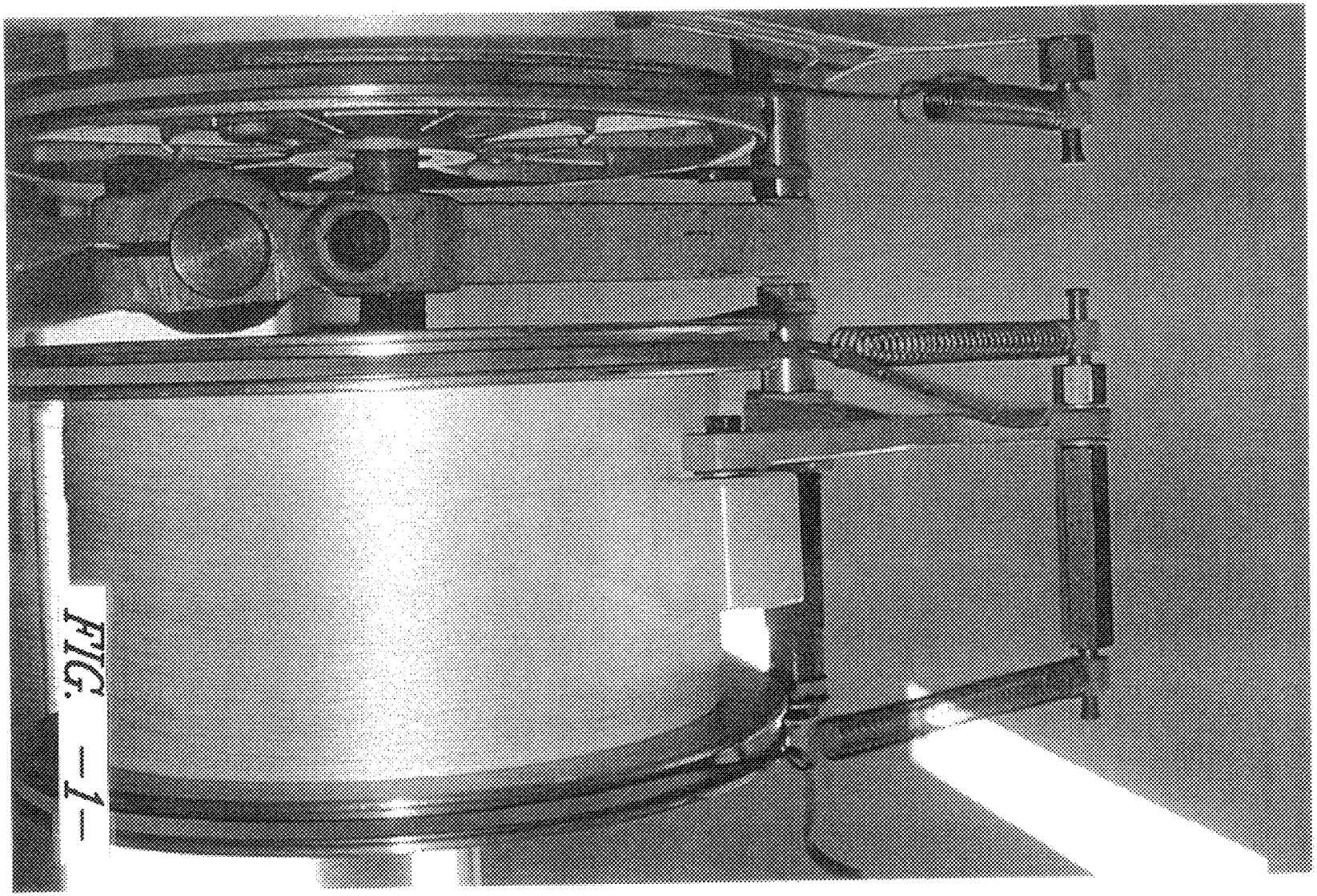
FIGS. 1 and 2 are photographic representations of a conventional selvage yarn tensioning device.
Figure 2:
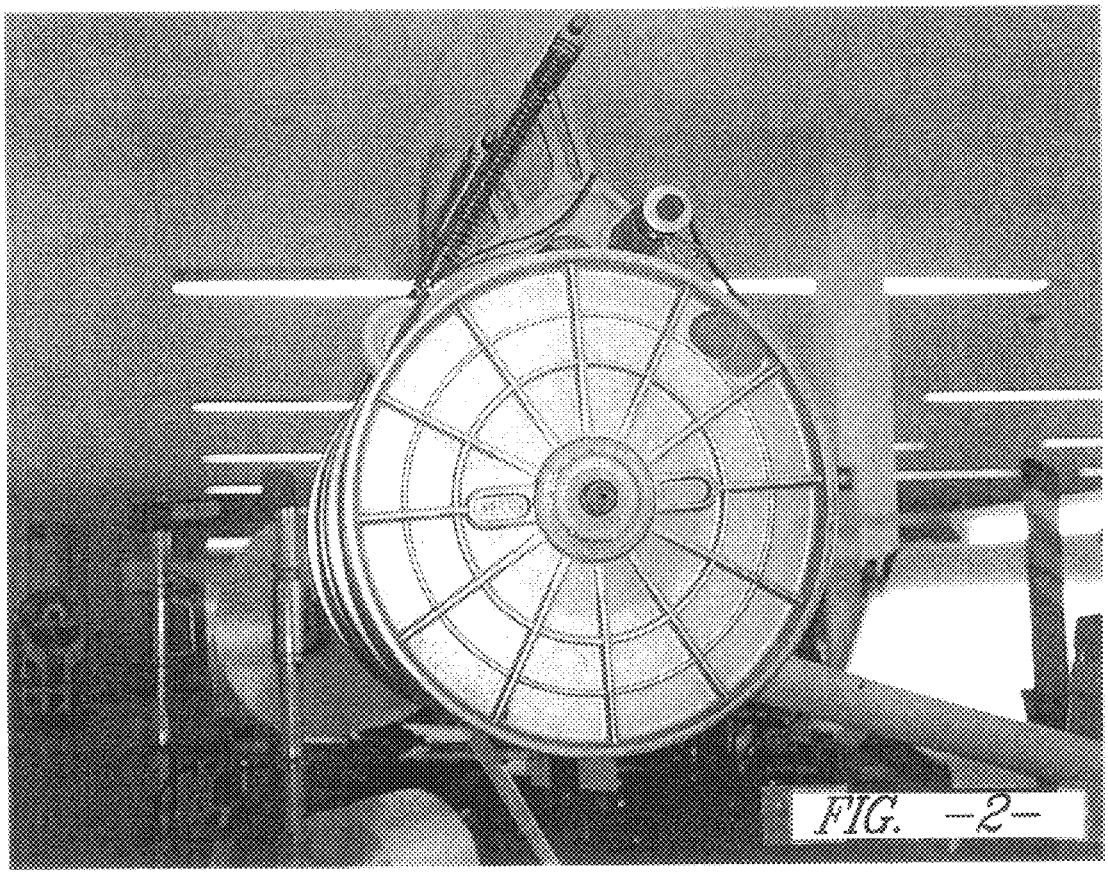

FIGS. 1 and 2 are photographic representations of a conventional selvage yarn tensioning device.

Figure 3:
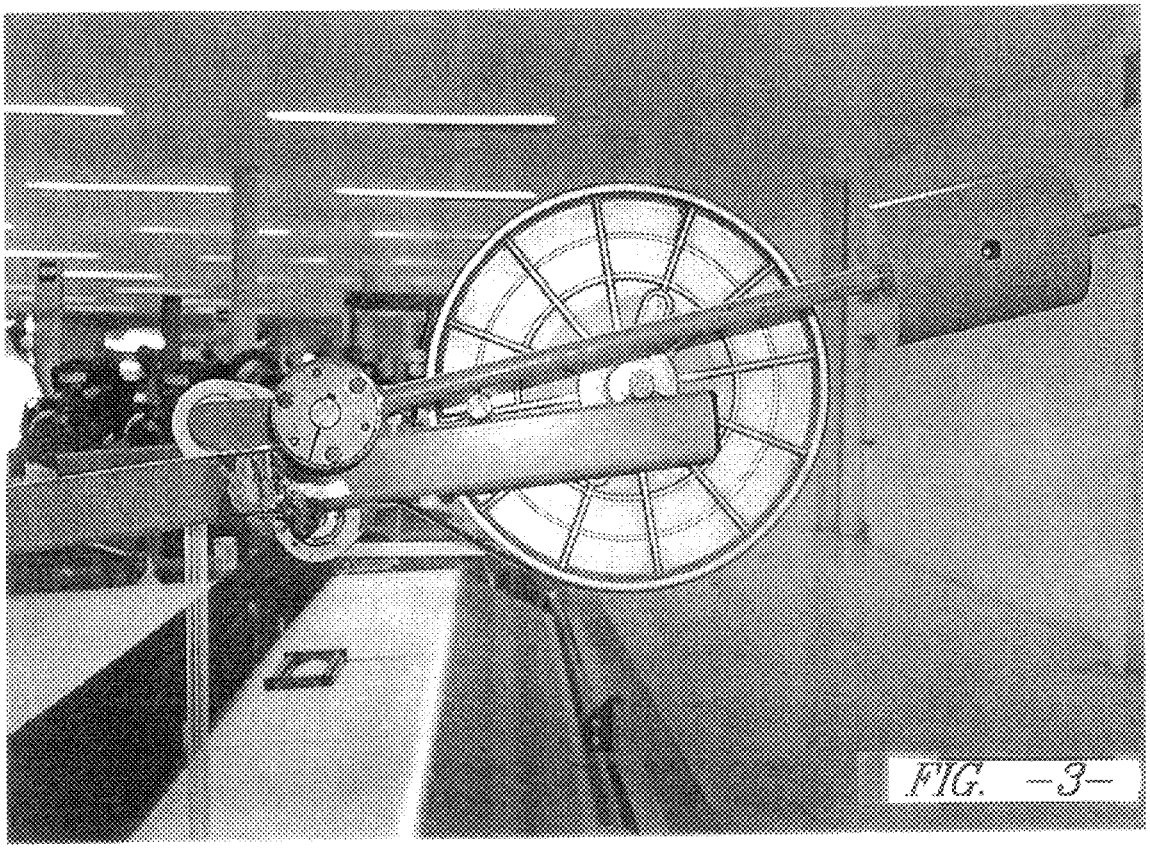
FIGS. 3 through 5 are photographic illustrations of an exemplary embodiment of the selvage yarn tensioning device of the present invention.
Figure 4:
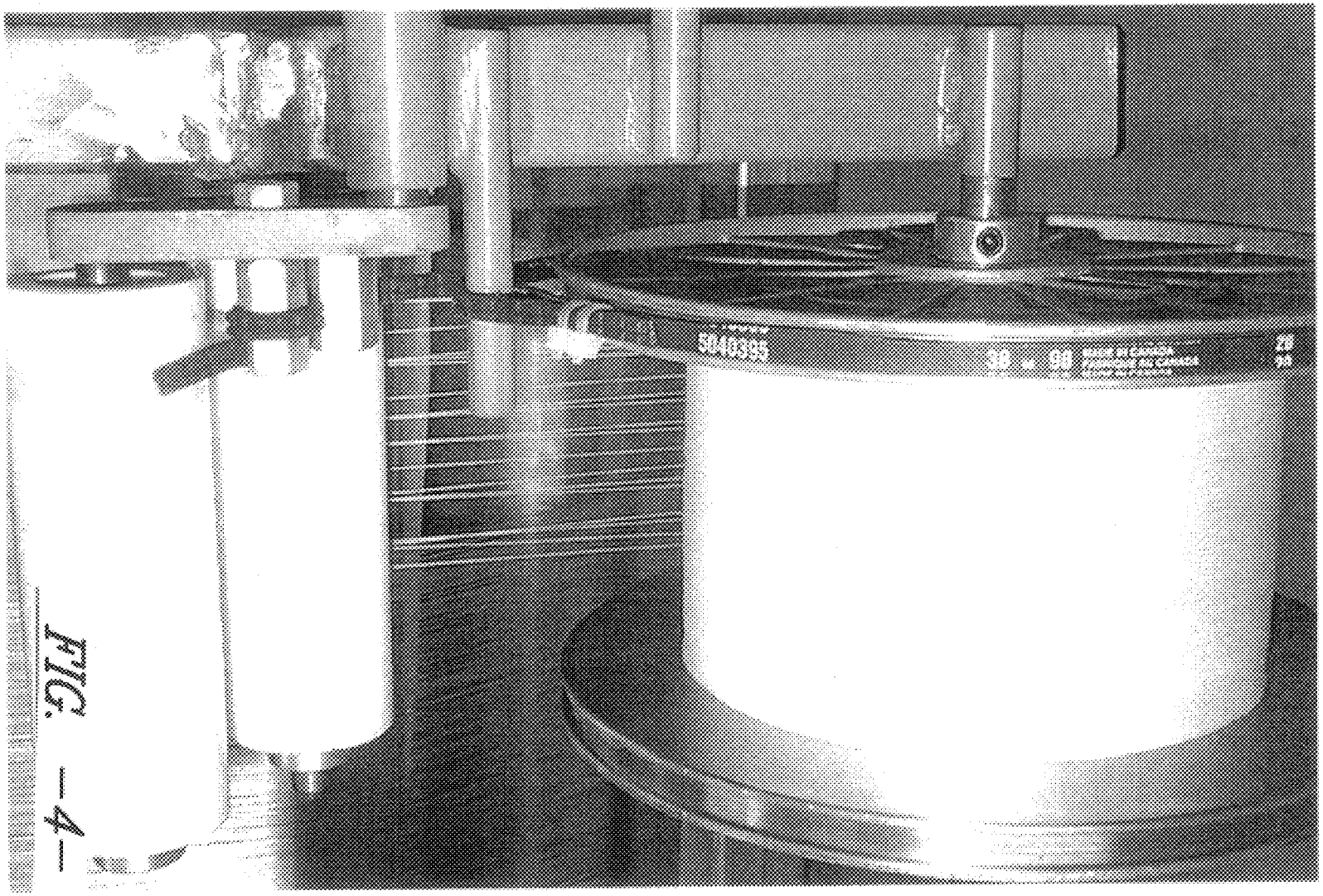
Figure 5:
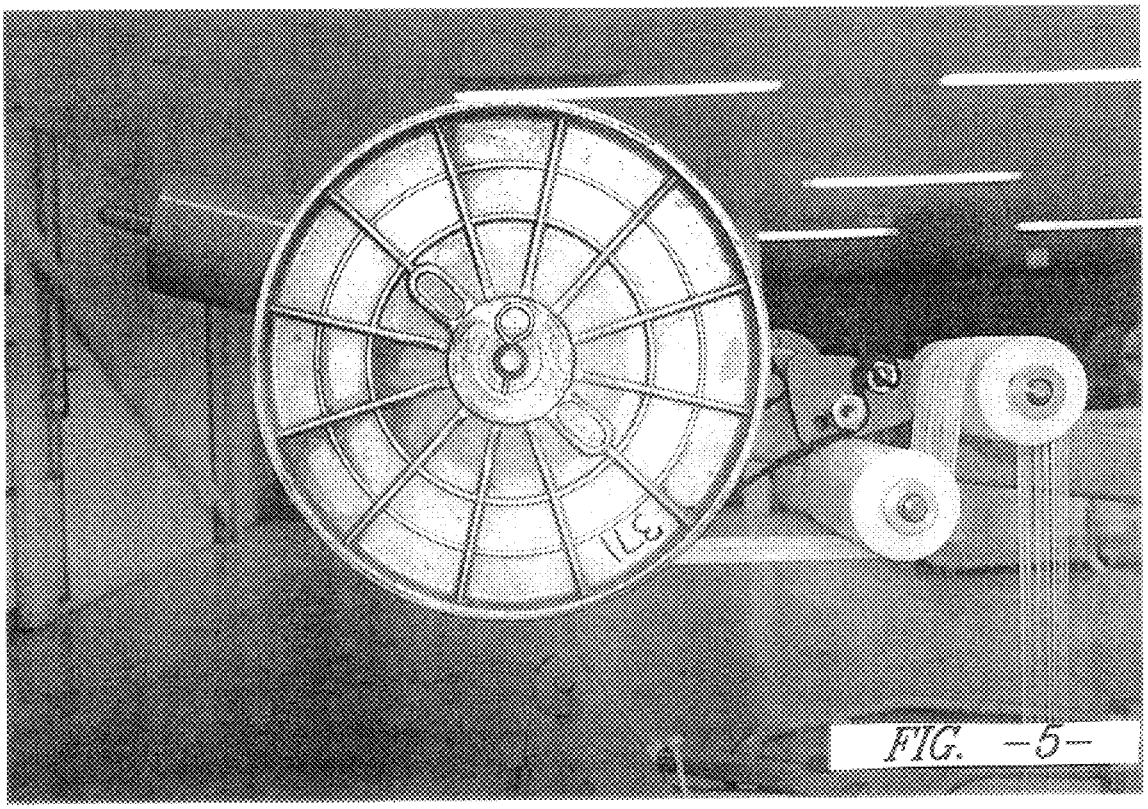

FIGS. 3 through 5 are photographic illustrations of an exemplary embodiment of the selvage yarn tensioning device of the present invention.

Figure 6:
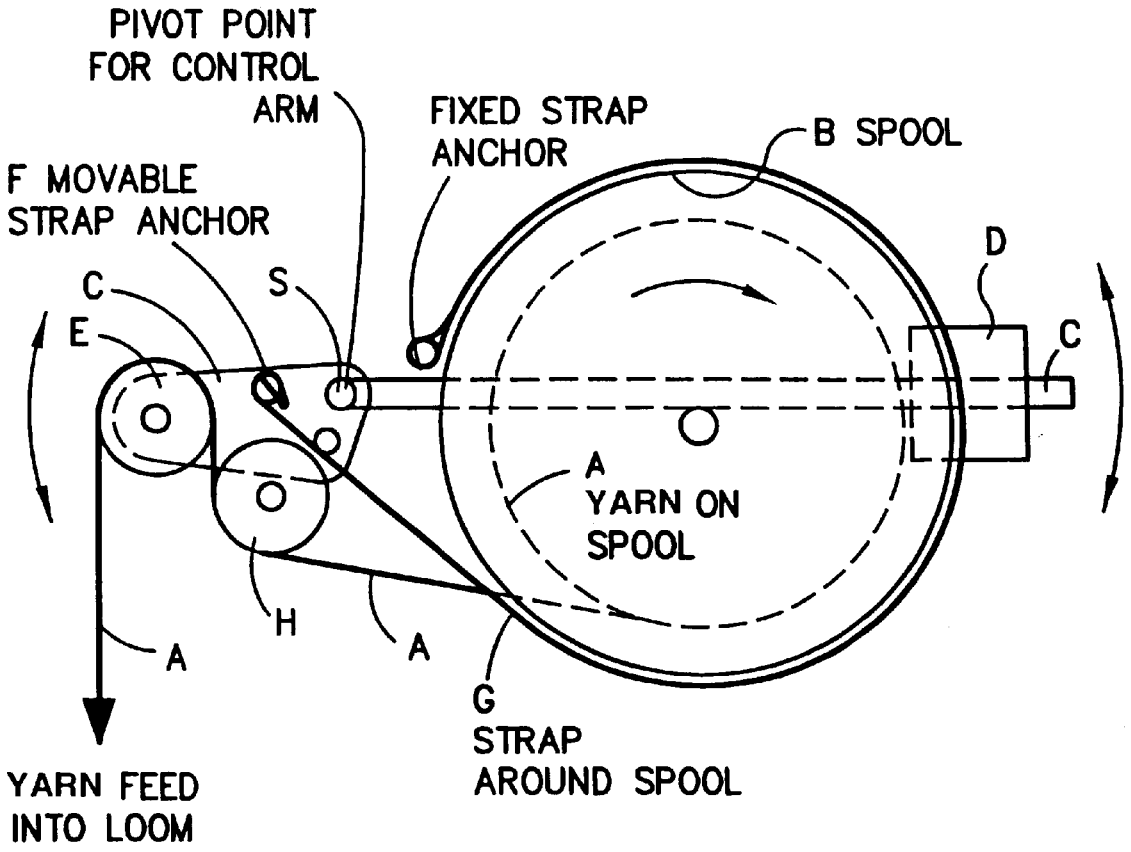
FIG. 6 is a semantic side view representation of a one embodiment of the selvage yarn tensioning device of the present invention.
Figure 7:
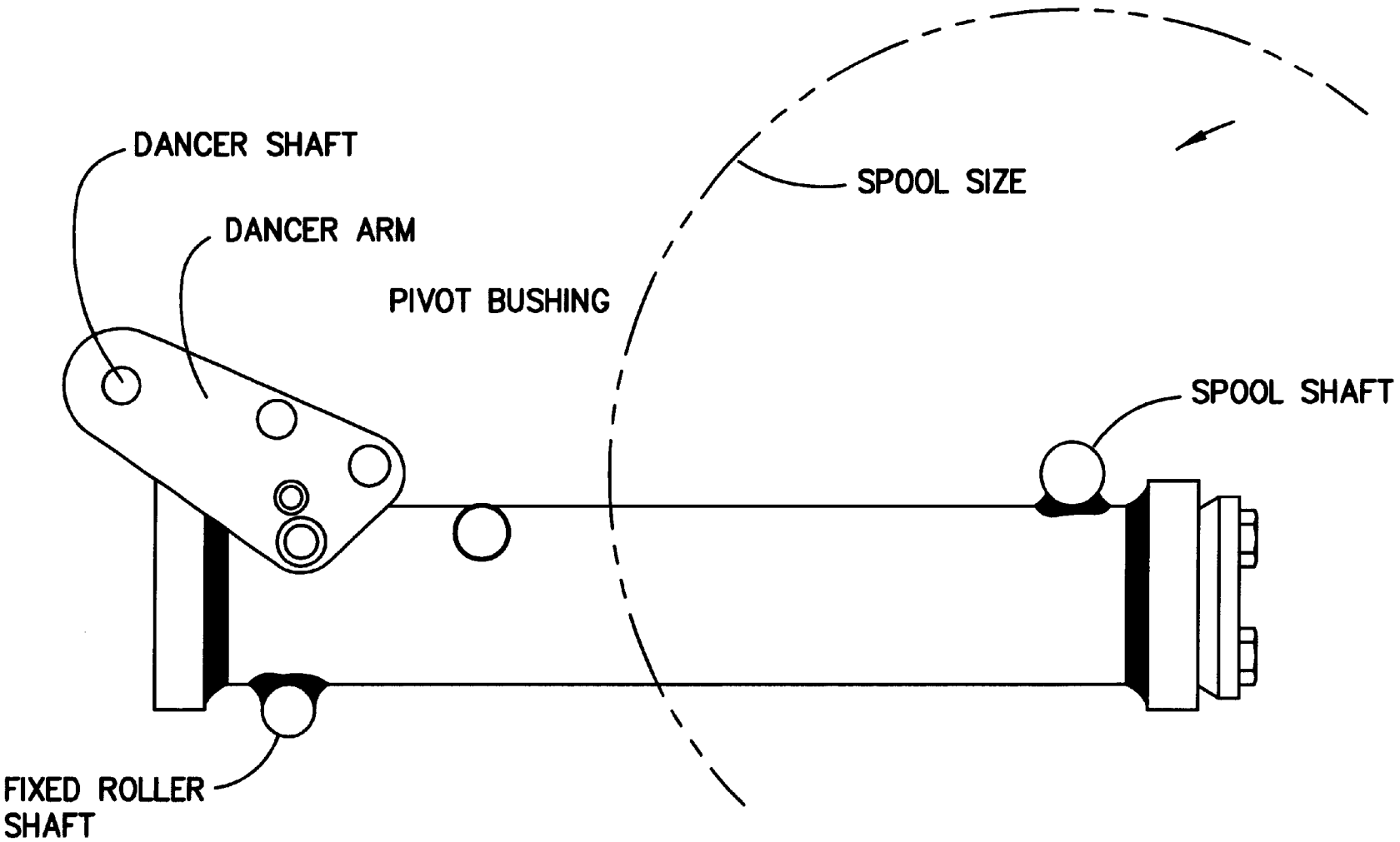
Figure 8:
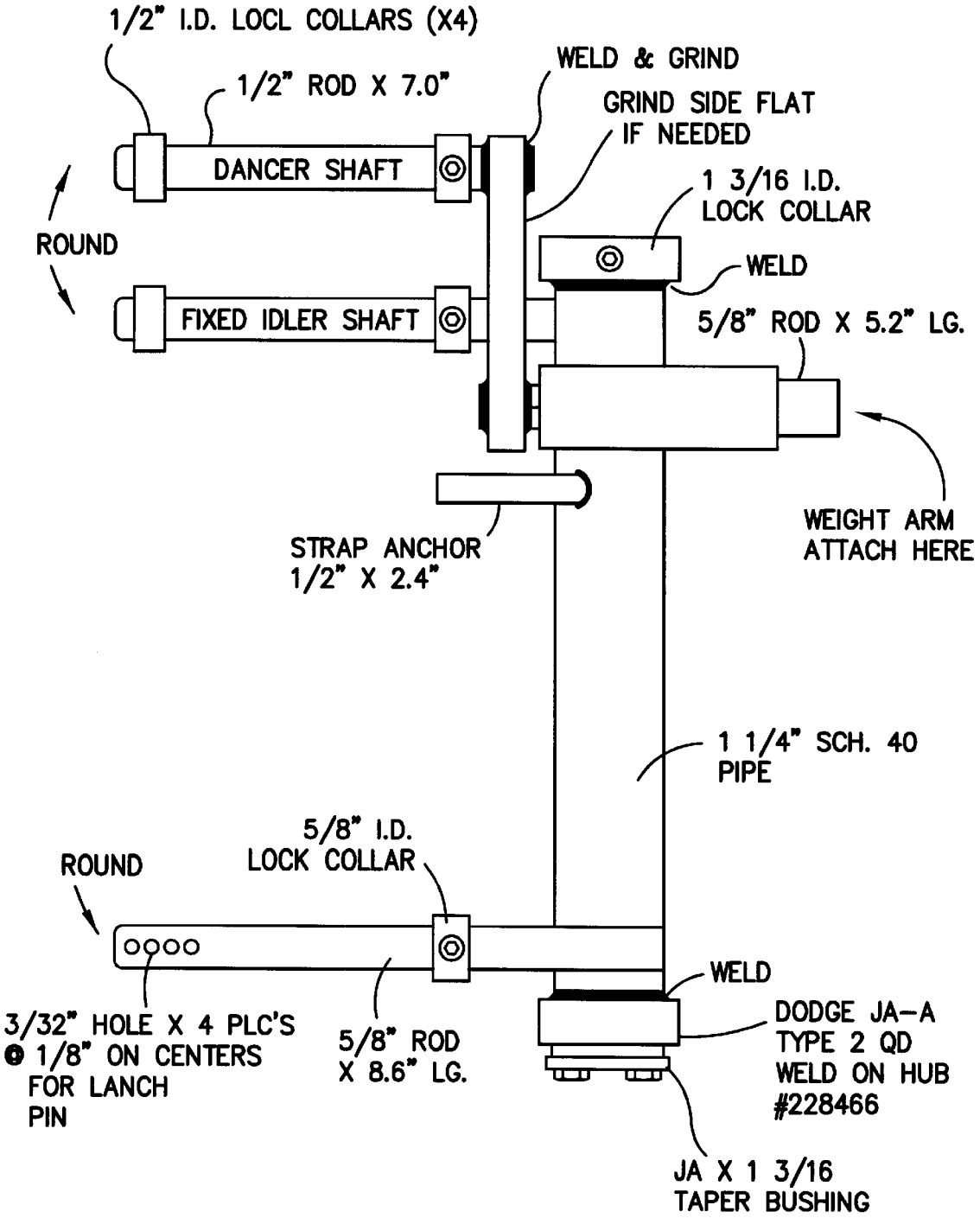
Figure 9:
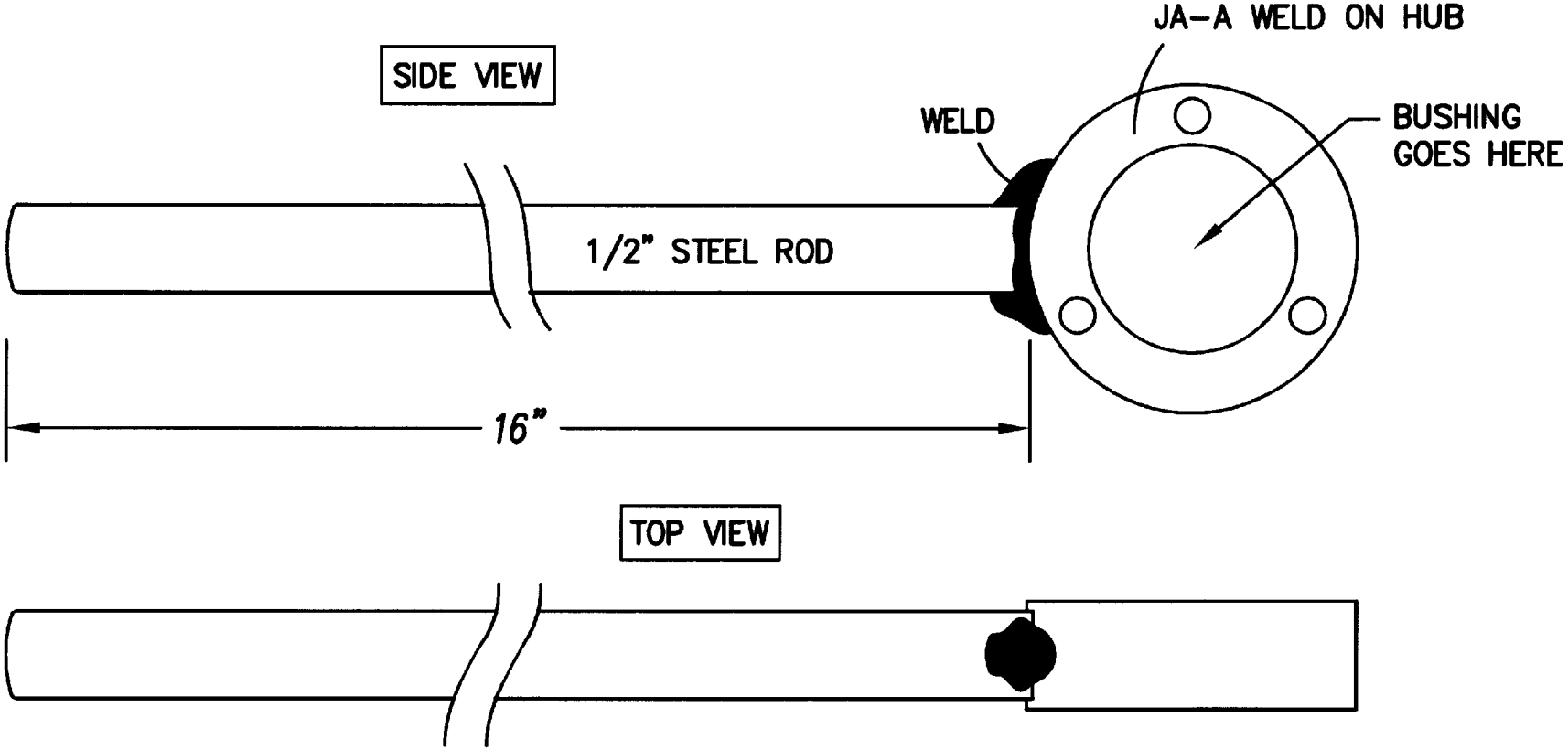
Figure 12:
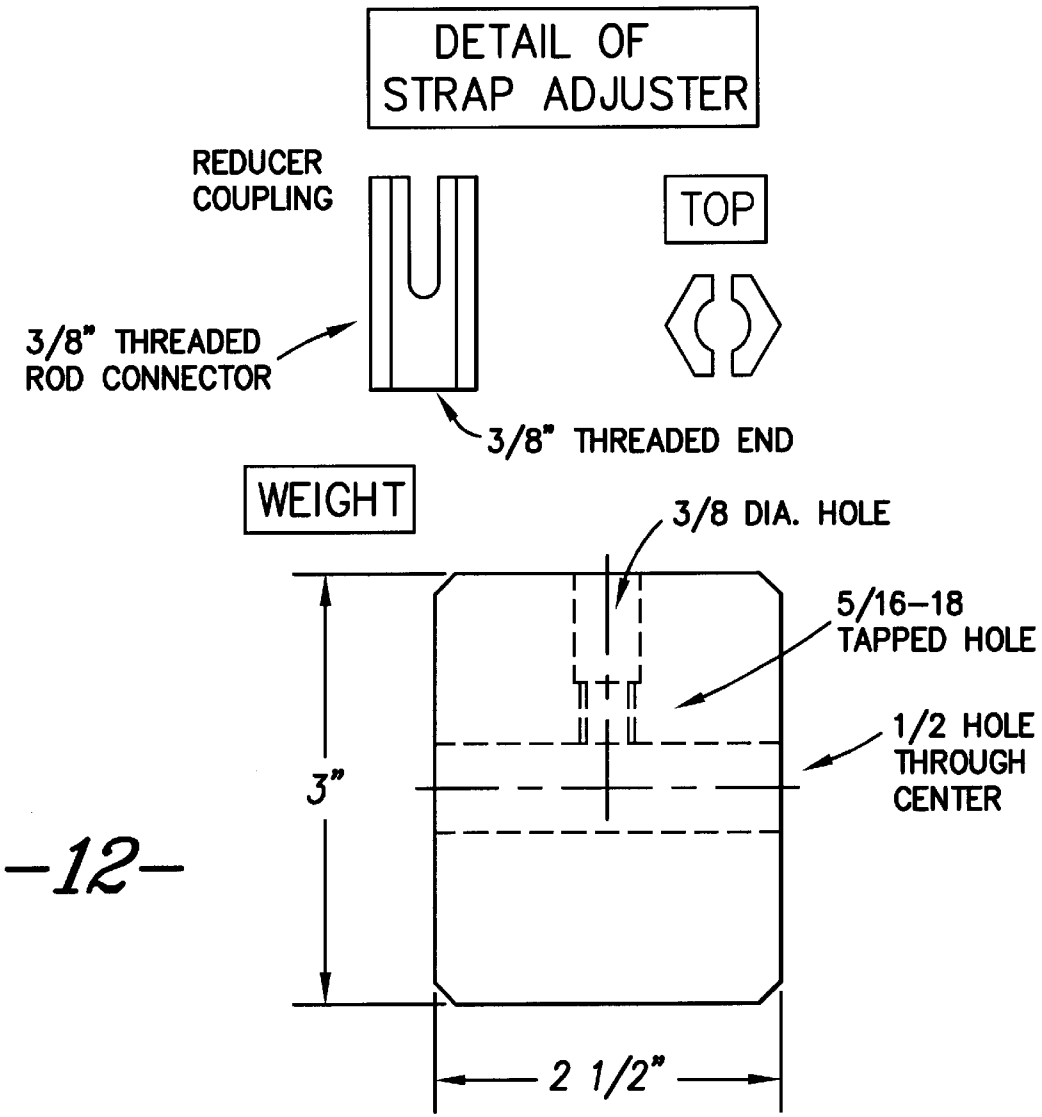

FIG. 6 shows a selvage yarn tensioning mechanism in accordance with an exemplary embodiment of the present invention. Yarn (A) is wound on a spool (B). A control arm (C) has a counterbalance weight (D) on one side of a pivot shaft (S) while a tension measuring roller (E) and an attachment point (F) for a braking strap or tensioning strap (G) or other tensioning means are on the other side of the pivot shaft (S). The yarn (A) from the spool (B) is arranged over roller (E) such that the tension force of the yarn applies force on the control arm (C) to counter the force acting in the opposite direction applied by the weight (D). The balancing of forces between the yarn tension and the weight causes movement of the tensioning strap (G) attachment point (F) such that the strap is either tightened or loosened in conjunction with movement of the control arm. At least one additional roller (H) can be optionally provided to keep the angle of the yarn around the tension measuring roller (E) constant as the diameter of the yarn wound on the spool changes.

In summary, the device preferably operates as follows: If the yarn tension is lower than the counter balance force provided by the weight, the weight position will fall and the measuring roller will rise. As the measuring roller rises, the strap attachment point moves in such a way to tighten the tensioning strap and thus increasing the yarn tension. If the yarn tension is too high in relation to the counterbalancing force provided by weight, the measuring roller will move downward. As the measuring roller moves downward, the strap attachment point will move in such a way as to loosen the tensioning strap, thus decreasing the tension on the yarn. Thus, the yarn tension is automatically regulated by the balancing of the yarn tension acting against the constant of the weight.

The yarn tensioning device of the present invention has several advantages.

I. It can be installed in any orientation (i.e. vertical instead of horizontal) or in the reverse side or mirrored image of the shown drawings.

II. The tension control arm can actuate any type of braking device or mechanism instead of the tensioning strap shown in the drawing.

III. The tension control arm can be counterbalanced by a spring or other force generating device such as a pneumatic actuator, hydraulic actuator, or a magnetic device.

IV. It can be used on a knitting, braiding, and weft insertion of any fabirc formation machine other than a loom.

It is contemplated that modifications can be made to enhance operation and simplify manufacture. For example, with reference to FIGS. 6 through 14 of the drawings, the present invention may use straps on the edge of the selvage yarn spool, may incorporate a strap brake on the shaft of the spool, or it may incorporate an off the shelf brake assembly operably attached to the shaft of the spool.

FIGS. 7 through 12 are respective schematic part drawings of the components of the selvage yarn tensioning device of FIG. 6.

Figure 13:
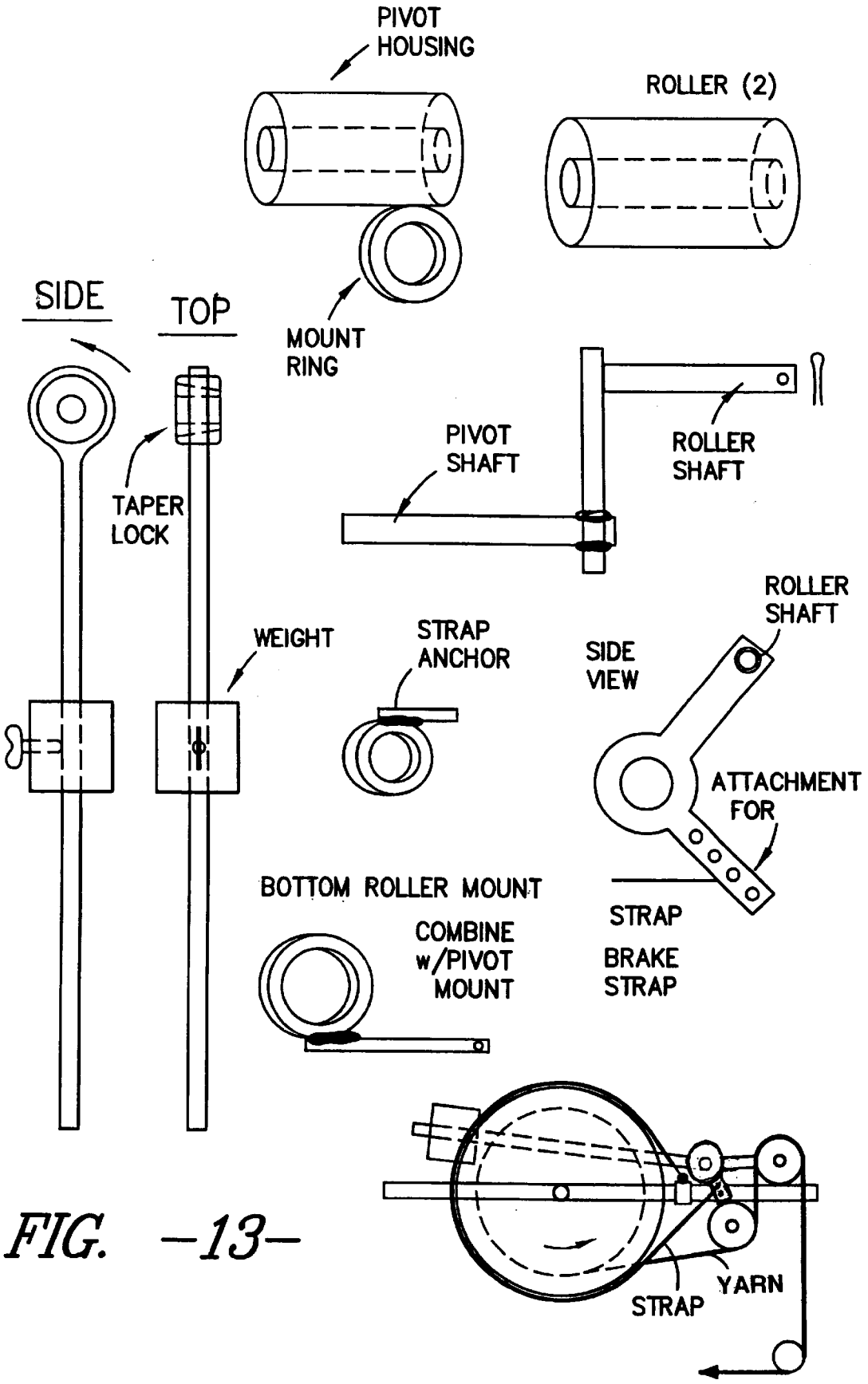

FIGS. 13 and 14 are schematic representations of different embodiments of the present invention.

FIG. 13 represents another embodiment and the respective schematic part drawings of the components thereof.

FIG. 14 represents three different embodiments (strap on spool arrangement, strap on shaft (or disc attached to shaft) of the spool, and a brake assembly operably attached to the spool shaft).

In accordance with the present invention, a preferred mechanism to automatically control tension of supplemental yarns added to a weaving or knitting machine has a pivotal control arm, one end of which is influenced by the tension of the yarn being controlled, while a counteracting force is applied to another portion of the arm. The movement of the arm is used to modulate and adjust a braking device acting against the yarn holding spool to keep the tension of the yarn substantially uniform over time as the diameter of the yarn wound on the storage spool changes.

In accordance with one embodiment, each of the rollers (E and H) is made from 2" diameter, white, PET (polyethylene terephthalate) rods sold my McMaster Carr, USA.

MATERIALS (ALL STEEL UNLESS NOTED)

| Quantity | |
|---|---|
| 1 | 1 ¼ schedule 40 pipe X 9" long |
| 4 | ½ ID set collars |
| *1 | 1 3/16" ID set collar |
| (*1) 2 | JA-A weld in hub to fit QD style size JA taper bushing |
| *1 | QD style - size JA X 1 3/16 bushing |
| 1 | QD style - size JA X ⅝ bushing |
| 1 | ⅜" threaded rod connector |
| 1 | ⅝" ID set collars |
| 1 | Pivot bushing - From 1" O.S. × ⅝ I.S. × 3.5" long |
| 1 | Dancer arm - From ½" to 2" flat bar X 4" long |
| 1 | Dancer shaft - ½" rod X 7.2" long w/1 end rounded - no keyway |
| 1 | Fixed Idler Shaft - ½" rod X 8.9 long w/1 end rounded |
| 1 | Spool shaft - ⅝" rod X 8.6" long w/1 end rounded w/hold |
| 1 | Strap anchor shaft - ½" rod X 2.4" long w/1 end cut at angle |
| 1 | Weight arm - ½" rod X 16" long |
| 2 | Idler rollers - from 2" diameter X 5.8" long PET Plastic w/hole in center w/1 end recessed cut |
| 1 | Weight - from 3" diameter rod X 2.5" long w/hole in center with ⅜/5/16 tapped hold for lock bolt |

*Not needed for alternate version (FIG. 13)

Alternate version (FIG. 13) needs also: 1 1¼ schedule 40 pipe × approximately12 ¾"# long 1½" X2" X7" flatbar In accordance with the present invention, airbag fabric may be produced with a tighter weave since the selvage yarn tensioning device, mechanism or apparatus of the present invention can provide more tension and a constant tension.

Also in accordance with the present invention there is a provided an improved weaving or knitting machine incorporating the selvage yarn tensioning device of the present invention.

Still further in accordance with the present invention there is provided an improved fabric produced by a weaving or knitting machine including one or more selvage yarn tensioning devices in accordance with the present invention.

Still yet further in accordance with the present invention, there is provided an improved and tighter woven fabric produced using the selvage yarn tensioning device of the present invention.

If the tension of the selvage yarn is not maintained substantially constant during the formation of a fabric on, for example, a weaving or knitting machine or loom, the edges or selvage of the fabric may curl or form a wave. In accordance with the present invention, the selvage of a produced fabric, woven item, or knitted item is maintained relatively flat with respect to the fabric by using a selvage yarn tensioning device which maintains a substantially constant tension.

By maintaining the selvage relatively flat, one may utilize more of the woven fabric, reduce the size of the selvage, and/or reduce the trim waste.

While specific embodiments of the invention have been illustrated and described, it is to be understood that the invention is not limited thereto, since modifications may certainly be made and other embodiments of the principals of this invention will no doubt occur to those skilled in the art. Therefore, it is contemplated by the appended claims to cover any such modifications and other embodiments as incorporate the features of this invention which in the true spirit and scope of the claims hereto.

What is claimed is:

1. A yarn tensioning apparatus for providing a substantially constant tension to one or more selvage yarns fed from a spool, comprising: a pivotal control arm having a pivot point intermediate its length, one end which is influenced by the tension of the yarn being controlled and the other end being influenced by a counteracting force, a braking device acting against the yarn holding spool, and wherein said counteracting force is supplied by a weight, whereby movement off the arm is used to modulate and adjust the braking device acting against the yarn holding spool to keep the tension of the yarn substantially uniform over time as the diameter of the yarn wound on the spool changes.

2. The yarn tensioning apparatus of claim 1, wherein said breaking device is a braking strap having one end operatively connected to said pivotal control arm.

3. The yarn tensioning apparatus of claim 1, wherein said one end of said control arm is operatively attached to a tension measuring roller, whereby the tension force of the yarn applies force to the tension measuring roller which applies force to the control arm opposite the weight and which causes the control arm to pivot.

4. The yarn tensioning apparatus of claim 2, wherein said braking strap applies a braking force to at least one edge of said spool.

5. The yarn tensioning apparatus of claim 1, wherein said braking device is operably attached to a shaft that supports said spool.

6. The yarn tensioning apparatus of claim 3, further comprising a yarn angle compensating roller to keep the angle of the yarn around the tension measuring roller substantially constant.

7. The yarn tensioning apparatus of claim 6, wherein said spool and said yarn angle compensating roller each rotate about a fixed axis, and wherein said tension measuring roller rotates about an axis which moves with said pivotal control arm.

8. In a weaving machine, the improvement comprising the apparatus of claim 1.

9. In a knitting machine, the improvement comprising the apparatus of claim 1.

10. The yarn tensioning apparatus of claim 2, wherein said braking strap applies a braking force to a shaft that supports said spool.

11. The yarn tensioning apparatus of claim 6, wherein said yarn angle compensating roller is located between said spool and said tension measuring roller.

12. The yarn tensioning apparatus of claim 6, wherein said spool, said yarn angle compensating roller, and said control arm each rotate about a fixed axis, and wherein said tension measuring roller rotates about an axis which moves with said one end of said pivotal control arm.

* * * * *